US010470641B2

(12) United States Patent
Chwalibog

(10) Patent No.: US 10,470,641 B2
(45) Date of Patent: Nov. 12, 2019

(54) DISHWASHER HAVING A DECORATIVE PANEL

(71) Applicant: WHIRLPOOL CORPORATION, Benton Harbor, MI (US)

(72) Inventor: Sebastian Jan Chwalibog, Bielany Wroclawskie (PL)

(73) Assignee: Whirlpool Corporation, Benton Harbor, MI (US)

( * ) Notice: Subject to any disclaimer, the term of this patent is extended or adjusted under 35 U.S.C. 154(b) by 100 days.

(21) Appl. No.: 15/681,864

(22) Filed: Aug. 21, 2017

(65) Prior Publication Data

US 2019/0053685 A1 Feb. 21, 2019

(51) Int. Cl.

*A47L 15/42* (2006.01)
*A47B 96/20* (2006.01)

(52) U.S. Cl.

CPC ..... *A47L 15/4265* (2013.01); *A47L 15/4257* (2013.01); *A47L 15/4293* (2013.01); *A47B 96/20* (2013.01); *A47B 2096/208* (2013.01)

(58) Field of Classification Search

CPC ..... A47L 15/4265
See application file for complete search history.

(56) References Cited

FOREIGN PATENT DOCUMENTS

| | | | |
|---|---|---|---|
| DE | 2806323 | A1 | 8/1979 |
| EP | 1611832 | A1 | 1/2006 |
| EP | 2110064 | B1 | 3/2011 |
| WO | 2016047034 | A1 | 3/2016 |

*Primary Examiner* — Jason Y Ko
(74) *Attorney, Agent, or Firm* — McGarry Bair PC

(57) ABSTRACT

A dishwasher includes a chassis, a tub partially defining a treating chamber, and a door pivotally mounted to the chassis and pivotally moveable between open and closed positions. A decorative panel for the dishwasher can include a slide adjuster for connecting the decorative panel to the door.

20 Claims, 6 Drawing Sheets

DISHWASHER HAVING A DECORATIVE PANEL

BACKGROUND

Contemporary automatic dishwashers for use in a typical household include a tub, at least one rack or basket for supporting soiled dishes within the tub, and a door for opening and closing the tub. Dishwashers can also include a decorative panel or cover for the door. Installation of the decorative panel can involve re-positioning the panel with respect to the door after an initial placement, including re-positioning to correct for an initial misalignment. It can be beneficial to simplify the positioning process for the decorative panel.

BRIEF DESCRIPTION

In one aspect, a dishwasher includes a chassis, a tub supported by the chassis and at least partially defining a treating chamber with an access opening, a door pivotally mounted to the chassis and pivotally movable between opened/closed positions to selectively close the access opening, a decorative panel for the door, a slide adjuster slidably connecting the decorative panel to the door and having a slot, a slider slidably received within the slot, and a locking member fixing the position of the slider relative to the slot, wherein the position of the decorative panel can be adjusted by sliding the decorative panel relative to the door and locking the slider relative to the slot.

In another aspect, a dishwasher door assembly includes a dishwasher door, a decorative panel for the door, a slide adjuster slidably connecting the decorative panel to the door and having a slot, a slider slidably received within the slot, and a locking member fixing the position of the slider relative to the slot, wherein the position of the decorative panel can be adjusted by sliding the decorative panel relative to the door and locking the slider relative to the slot.

In yet another aspect, a dishwasher includes a chassis, a tub supported on the chassis and at least partially defining a treating chamber having an access opening, a door pivotally mounted to the chassis for pivotal movement between a closed position, wherein the access opening is closed, and an opened position, wherein the access opening is opened, a decorative panel for the door, a plinth spaced apart from the decorative panel and forming a space between the plinth and decorative panel, a slide adjuster mounting the decorative panel to the door to adjust the space between the plinth and the decorative panel, and a locking member locking the decorative panel on the door with respect to the plinth.

DESCRIPTION OF EMBODIMENTS

Figure 1:
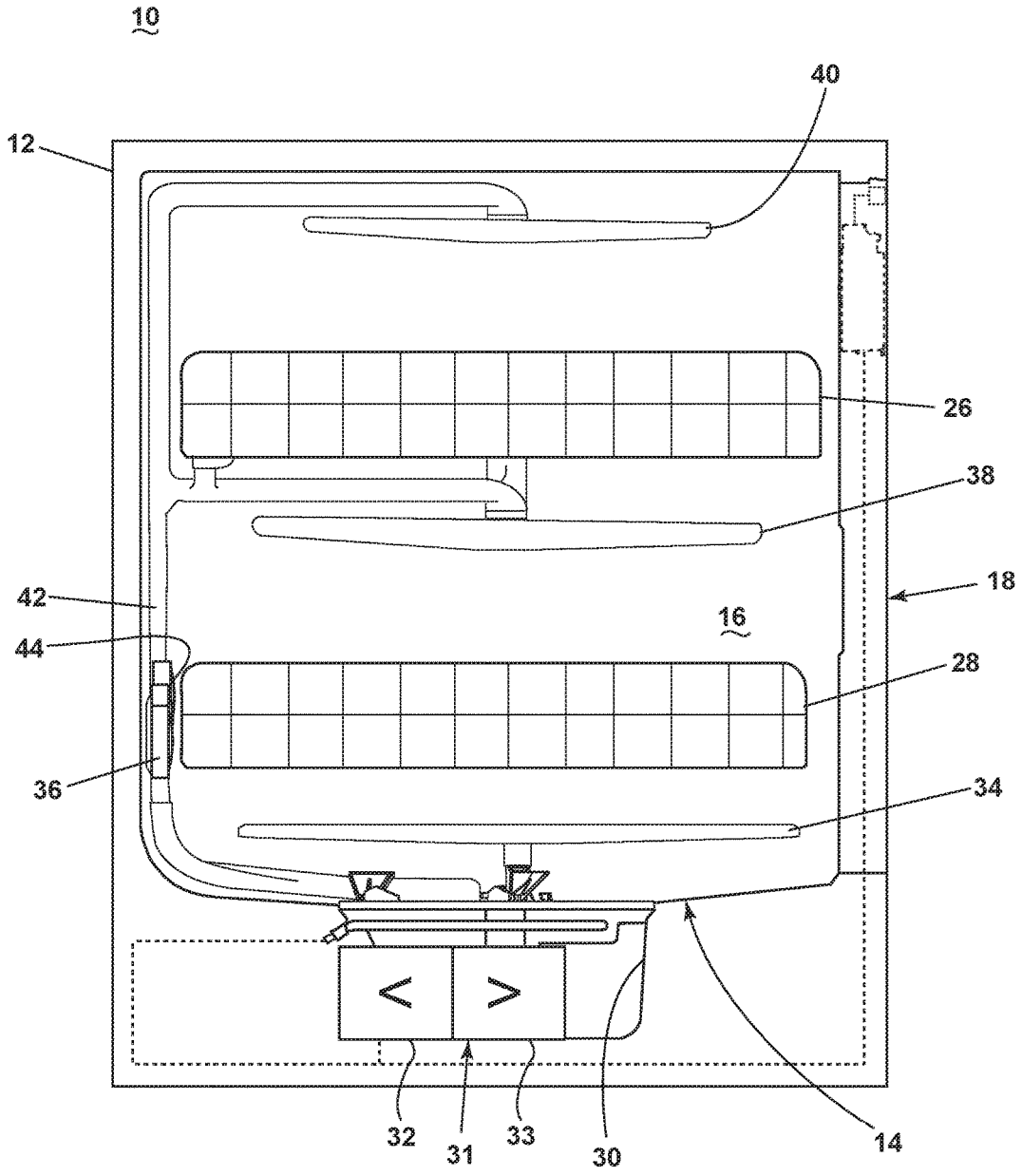
FIG. 1 is a schematic, cross-sectional view of a dishwasher according to various aspects described herein.

Aspects described herein are directed to a decorative door panel or cover of a dishwasher. In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door, such as a door assembly 18, may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

Figure 2:
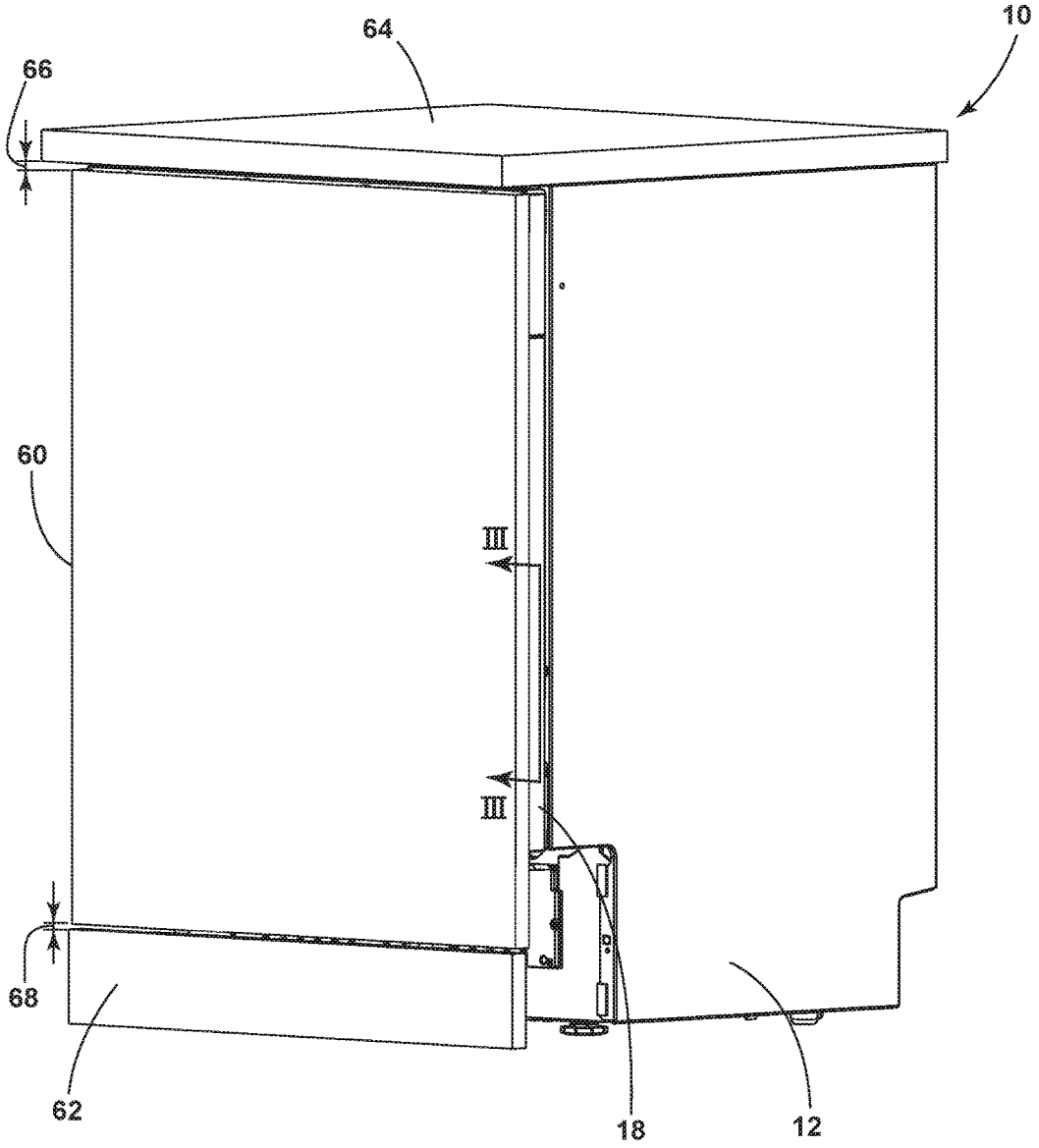
FIG. 2 illustrates a decorative panel which can be utilized on the dishwasher of FIG. 1.

Turning to FIG. 2, a decorative panel 60 can be mounted to the door assembly 18 and can cover at least a portion of the door assembly 18. In the example shown, the decorative panel 60 is mounted over the entire door assembly 18. The dishwasher 10 can include a plinth 62 mounted to a lower portion of the chassis 12, as well as a top surface 64 mounted to an upper portion of the chassis 12. In this manner an upper gap 66 can be defined between the panel 60 and top surface 64, and a lower gap 68 can be defined between the panel 60 and plinth 62 as shown.

Figure 3:
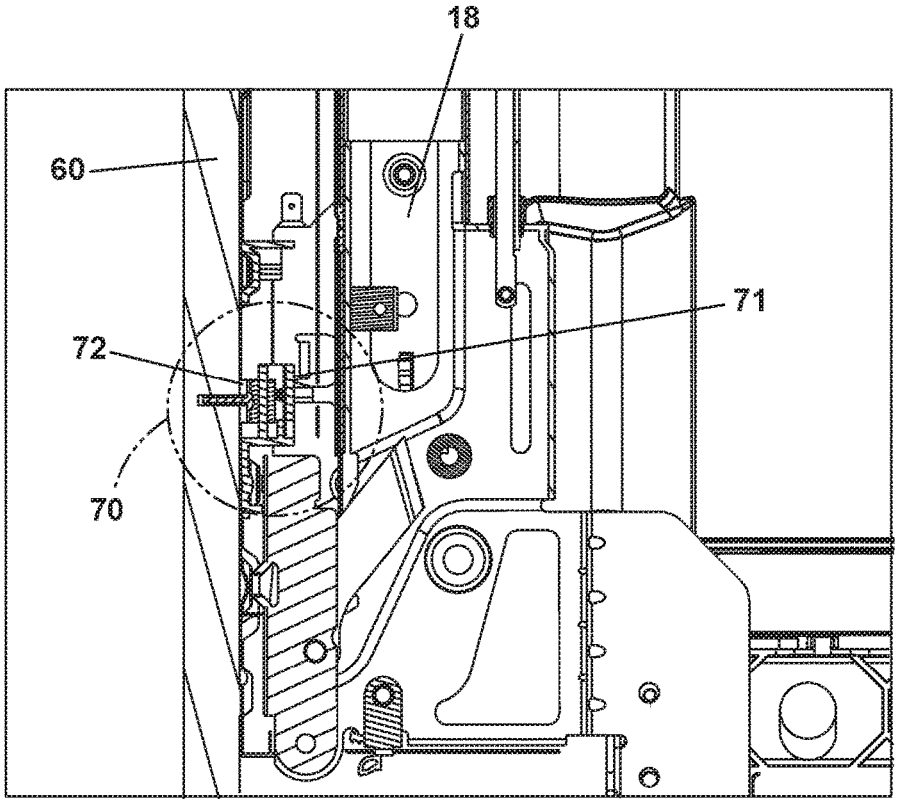
FIG. 3 is a cross-sectional view of a slide adjuster mounted to the decorative panel of FIG. 2, taken along the line III-III.

Turning to FIG. 3, the door assembly 18 can include a slide adjuster 70 for the decorative panel 60. The slide adjuster 70 can include a mounting bracket 71 having a slider 72 and mounted to the door assembly 18. As illustrated, the slider 72 can be coupled to the panel 60 while the mounting bracket 71 can be coupled to the door 18, where suitable hardware such as screws or bolts can be utilized for coupling components. It should be recognized that the components of the slide adjuster 70 can be reversed without limiting the scope of the disclosure.

Figure 4:
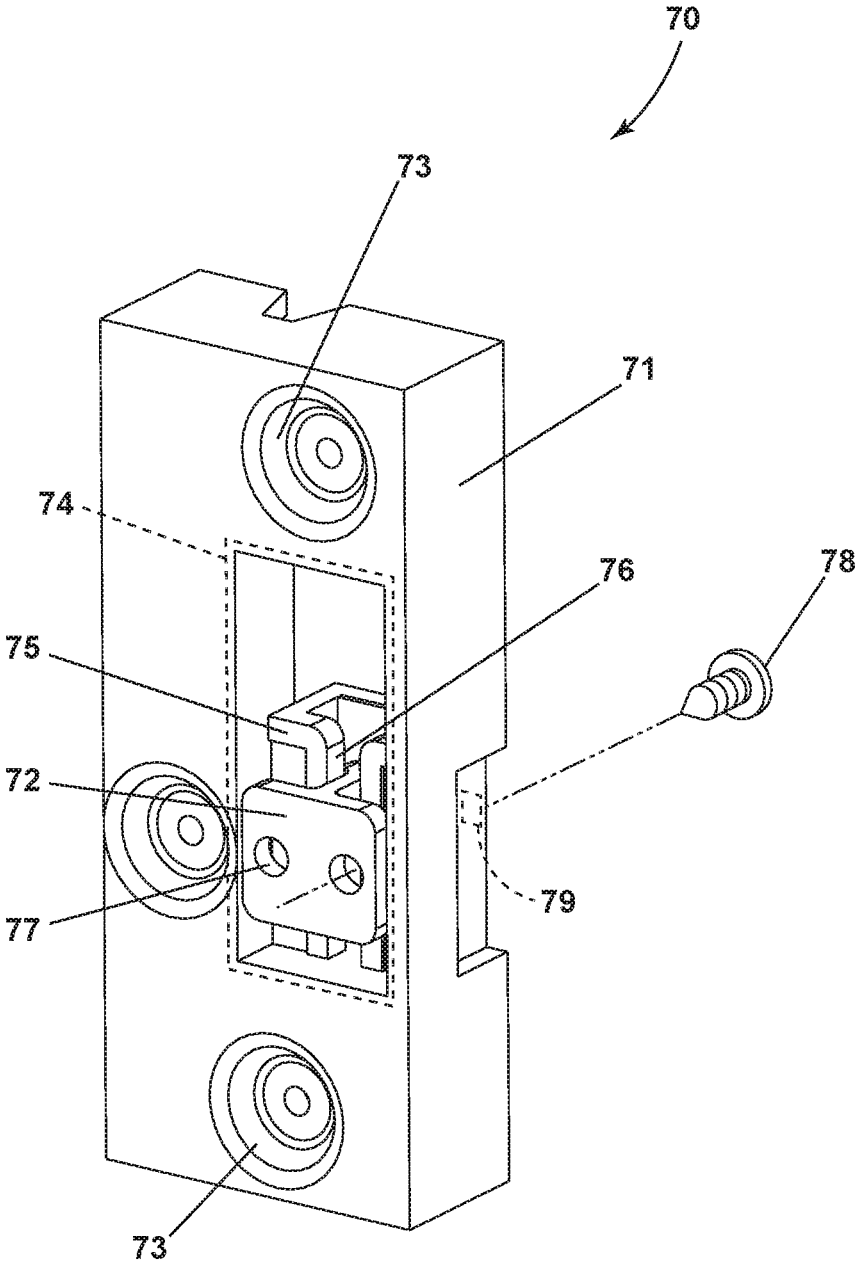
FIG. 4 illustrates the slide adjuster of FIG. 3.

FIG. 4 illustrates the slide adjuster 70 in further detail. The mounting bracket 71 can include a set of bracket holes 73 for coupling or securing to the door assembly 18. The bracket 71 can also include a cutout 74 having a projection 75 with a slot 76. The slider 72 is illustrated with an I-shaped profile and can be slidably received in the slot 76; in addition, the slider 72 can include a set of slider holes 77 for coupling or securing to the panel 60. A locking member, illustrated as a locking bolt 78, can be received in an aperture 79 such as a bolt hole in the mounting bracket 71. The locking bolt 78 and aperture 79 can be configured with complementary threads so the bolt 78 can be screwed in the aperture 79 to compress the slider 72 against the projection 75 on the bracket 71.

When assembled, the mounting bracket 71 of the slide adjuster 70 can be mounted to the door assembly 18 via the user of appropriate hardware, such as screws or bolts, received in the bracket holes 73 and tightened. The decorative panel 60 can be coupled to the slider 72 via the use of screws, bolts, or other hardware received in the slider holes 77 and tightened. It can be appreciated that the decorative panel 60 can therefore be vertically moveable with respect to the door assembly 18 after coupling with the slide adjuster 70 for adjusting the upper and lower gaps 66, 68 between the decorative panel 60 and the top surface 64 and plinth 62, respectively. In a non-limiting example, the decorative panel 60 can be vertically adjusted between about 0 mm and 8 mm relative to the door assembly 18 to equalize the upper and lower gaps 66, 68.

Figure 5:
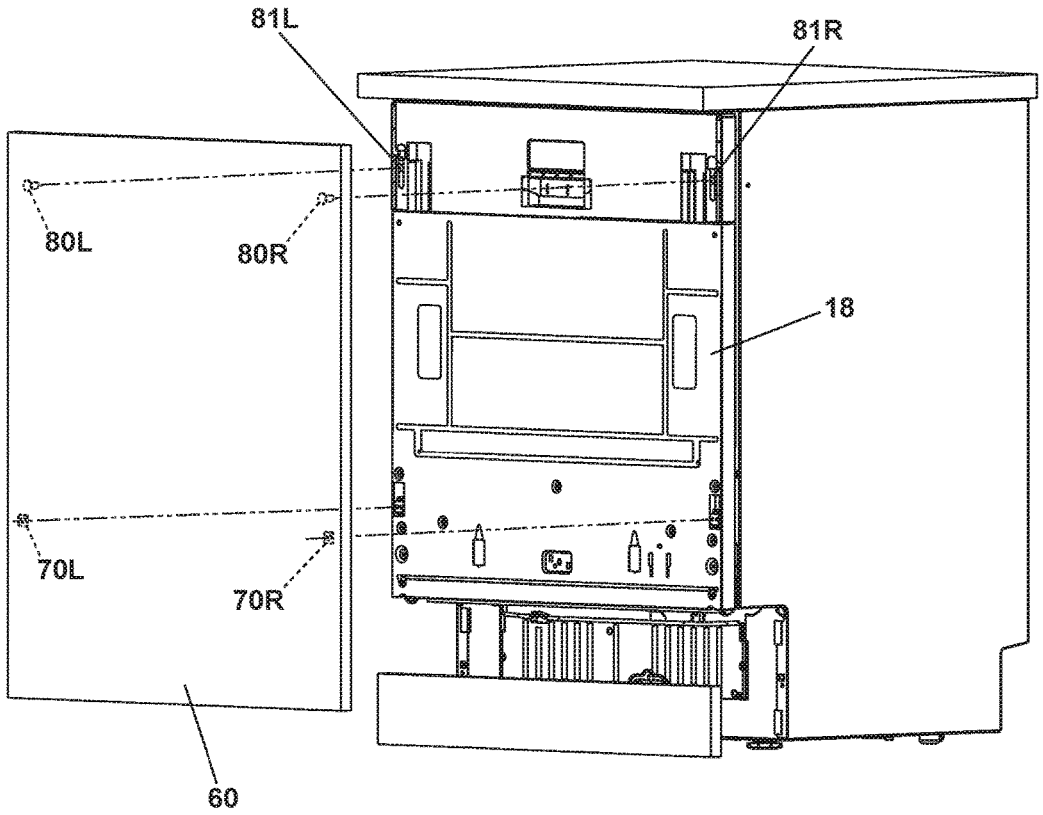
FIG. 5 illustrates adjusting a position of the decorative panel of FIG. 2 to the dishwasher of FIG. 1.

Referring now to FIG. 5, it is contemplated that the decorative panel 60 can be coupled to a left slide adjuster 70L and a right slide adjuster 70R, both at a lower portion of the panel 60. An upper portion of the panel 60 can include a set of traditional mounting hardware, illustrated as a left bushing 80L and a right bushing 80R. The door assembly 18 can include a left receiving space 81L into which the left bushing 80L can be placed, as well as a right receiving space 81R into which the right bushing 80R can be placed. Bushings 80L and 80R can be screwed into the panel 60 to aid in maintaining a parallel position of the panel 60 with respect to the door assembly 18 during installation.

Figure 6:
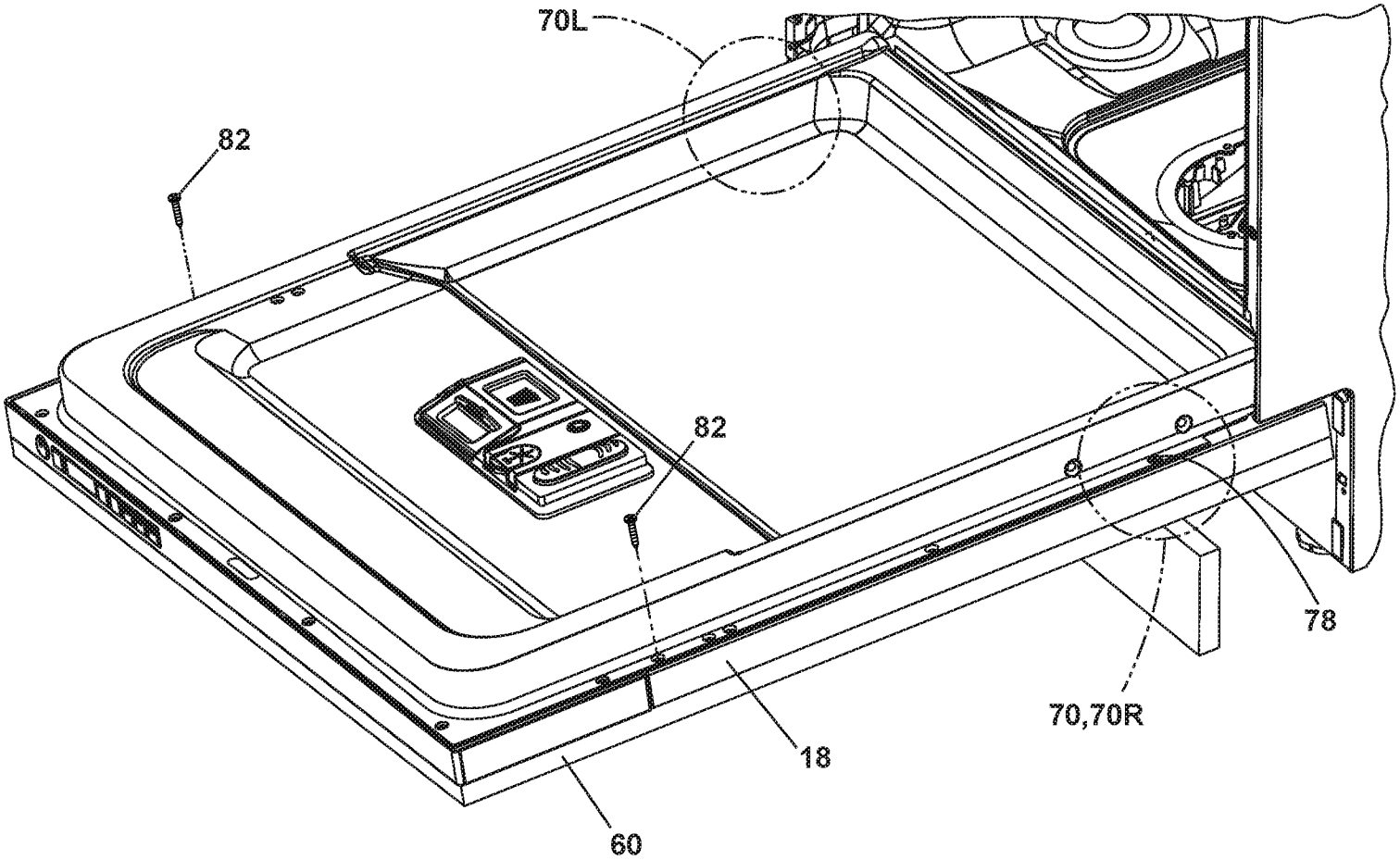
FIG. 6 illustrates locking the decorative panel of FIG. 2 to the dishwasher of FIG. 1.

FIG. 6 illustrates the door assembly 18 in an open position, where the locking bolt 78 of the right slide adjuster 70R is visible. During installation of the decorative panel 60 it is possible that the upper and lower gaps 66, 68 can be formed unequally, such as the upper gap 66 being larger than the lower gap 68. To install the decorative panel 60, it is contemplated that the panel 60 (FIG. 3) can be coupled to each slider 72 (FIG. 4) of the left slide adjuster 70L and the right slide adjuster 70R (FIG. 5), as well as coupling to the left and right bushings 80L, 80R, with the door assembly 18 in a closed position. The door assembly 18 can be opened and the panel 60 can be vertically adjusted to a desired position relative to the door assembly 18, examples of which include a position that creates equally-sized upper and lower gaps 66, 68 (FIG. 2), or where the panel 60 is flush with the top of the door assembly 18, or any other desired configuration. It is also contemplated that the door assembly 18 can be closed to check the size of the upper and lower gaps 66, 68, and re-opened to adjust the sliders 72 if desired. Once the panel 60 is in position, the door assembly 18 can be opened (FIG. 6) and the locking bolt 78 of each slide adjuster 70L, 70R can be tightened to fix the sliders 72 in position. To affix the upper portion of the panel 60, hardware such as wood screws 82 (FIG. 6) can be screwed through the door assembly 18 into the decorative panel 60.

Decorative panels for appliances have traditionally been mounted onto the appliance door using standard hardware such as screws. In the event of a misalignment it can be difficult or impossible to re-position the panel, or additional screw holes may need to be formed in the cover which can be aesthetically undesirable. It can therefore be appreciated that aspects of the present disclosure provide for the ability to adjust a vertical position of the decorative panel via the motion of the slider along the slot, and the ability to set that position using the locking member. Utilization of a left and right slide adjuster can provide for an improved horizontal alignment of the decorative panel on the appliance door, while the use of less-complex hardware (such as screws) on the upper portion of the panel can optimize costs of the door assembly.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a chassis;

a tub supported by the chassis and at least partially defining a treating chamber with an access opening;

a door pivotally mounted to the chassis and pivotally movable between opened/closed positions to selectively close the access opening;

a slide adjuster having a slot, a slider slidably received within the slot, and a locking member fixing the position of the slider relative to the slot; and a decorative panel for the door mounted to the slider at a fixed position relative to the slot, with the fixed position being adjustable by sliding the decorative panel relative to the door and locking the slider relative to the slot.

2. The dishwasher of claim 1 further comprising a mounting bracket located on the door and defining the slot.

3. The dishwasher of claim 2 wherein the slider is mounted to one of the decorative panel or the door, and the mounting bracket is mounted to the other of the decorative panel or the door.

4. The dishwasher of claim 3 wherein the slider is I-shaped.

5. The dishwasher of claim 3 wherein the slider is slideably received in the slot on the mounting bracket.

6. The dishwasher of claim 5 wherein the locking member locks the slider with respect to the mounting bracket.

7. The dishwasher of claim 6 wherein the mounting bracket further comprises an aperture for receiving the locking member.

8. The dishwasher of claim 7 wherein the locking member is a bolt received through the aperture to compress the slider against the bracket.

9. The dishwasher of claim 1 wherein the slide adjuster is configured to allow the decorative panel to be vertically adjustable between about 0 mm to 8 mm relative to the door.

10. The dishwasher of claim 1 wherein the slide adjuster comprises a left slide adjuster mounting a left side of the decorative panel to the door, and a right slide adjuster mounting a right side of the decorative panel to the door.

11. A dishwasher door assembly comprising:

a door;

a slide adjuster having a slot, a slider slidably received within the slot, and a locking member fixing the position of the slider relative to the slot; and a decorative panel for the door mounted to the slider at a fixed position relative to the slot, with the fixed position being adjustable by sliding the decorative panel relative to the door and locking the slider relative to the slot.

12. The dishwasher of claim 11 further comprising a mounting bracket located on the door and defining the slot.

13. The dishwasher of claim 12 wherein the slider is mounted to one of the decorative panel or the door, and the mounting bracket is mounted to the other of the decorative panel or the door.

14. The dishwasher of claim 13 wherein the slider is slideably received in the slot on the mounting bracket.

15. The dishwasher of claim 14 wherein the locking member locks the slider with respect to the mounting bracket.

16. The dishwasher of claim 15 wherein the mounting bracket further comprises an aperture for receiving the locking member to lock the slider with respect to the bracket.

17. The dishwasher of claim 16 wherein the locking member is a bolt received through the aperture to compress the slider against the bracket.

18. The dishwasher of claim 11 wherein the slide adjuster is configured to allow the decorative panel to be vertically adjustable between about 0 to 8 mm relative to the door.

19. A dishwasher comprising:

a chassis;

a tub supported on the chassis and at least partially defining a treating chamber having an access opening;

a door pivotally mounted to the chassis for pivotal movement between a closed position, wherein the access opening is closed, and an opened position, wherein the access opening is opened;

a decorative panel for the door;

a plinth spaced apart from the decorative panel and forming a space between the plinth and decorative panel; and a slide adjuster slidably connecting the decorative panel to the door and having a slot, a slider mounted to the decorative panel and slidably received within the slot, and a locking member fixing the position of the slider relative to the slot, to adjust the space between the plinth and the decorative panel.

20. The dishwasher of claim 19 wherein the locking member is a bolt received through an aperture in the slide adjuster to lock the decorative panel with respect to the door.

* * * * *